US005108274A

United States Patent [19]

Kakuda et al.

[11] Patent Number: 5,108,274

[45] Date of Patent: Apr. 28, 1992

[54] SCROLL-TYPE FLUID MACHINE WITH COUNTER-WEIGHT

[75] Inventors: Masayuki Kakuda; Yoshihisa Kitora; Toshihide Koda, all of Amagasaki, Japan

[73] Assignee: Mitsubishi Denki Kabushiki Kaisha, Tokyo, Japan

[21] Appl. No.: 610,779

[22] Filed: Nov. 8, 1990 (Under 37 CFR 1.47)

[30] Foreign Application Priority Data

Dec. 25, 1989 [JP] Japan ..... 1-337891
Jun. 20, 1990 [JP] Japan ..... 2-163229

[51] Int. Cl.[5] ..... F01C 1/04; F01C 17/06

[52] U.S. Cl. ..... 418/55.1; 418/55.5; 418/57; 418/151

[58] Field of Search ..... 418/55.1, 55.5, 151, 418/57

[56] References Cited

U.S. PATENT DOCUMENTS

| | | | |
|---|---|---|---|
| 4,457,675 | 7/1984 | Inagaki et al. | 418/55.5 |
| 4,585,402 | 4/1986 | Morishita et al. | 418/94 |
| 4,585,403 | 4/1986 | Inaba et al. | 418/94 |
| 4,715,796 | 3/1986 | Inaba et al. | 418/55.5 |
| 4,764,096 | 8/1988 | Sawai et al. | 418/55.5 |
| 4,838,773 | 6/1989 | Noboru | 418/151 |

FOREIGN PATENT DOCUMENTS

| | | | |
|---|---|---|---|
| 57-49721 | 10/1982 | Japan . | |
| 58-19875 | 4/1983 | Japan . | |
| 59-120794 | 7/1984 | Japan . | |
| 62-0682 | 1/1987 | Japan | 418/151 |
| 62-13789 | 1/1987 | Japan | 418/151 |
| 1-262393 | 10/1989 | Japan | 418/55.5 |
| 1-273890 | 11/1989 | Japan | 418/151 |

*Primary Examiner*—John J. Vrablik
*Attorney, Agent, or Firm*—Oblon, Spivak, McClelland, Maier & Neustadt

[57] ABSTRACT

A scroll-type fluid machine includes a fixed scroll having a spiral wall; an orbiting scroll having a base plate which is on one side provided with a spiral wall, the orbiting scroll having the spiral wall combined with the spiral wall of the fixed scroll. A rotation preventing mechanism prevents the orbiting scroll from rotating about its own axis. A driving shaft is driven by a driving source, which has an eccentric portion, the eccentric portion causing the orbiting scroll to carry out orbiting movement through an orbiting bearing. A counterweight is coupled to the driving shaft in such manner that it takes an eccentric position at the side remote from the eccentric portion of the driving shaft and it has a play with respect to the driving shaft in a radial direction, which can balance with at least part of a centrifugal force caused at the orbiting scroll side, and which has radial movement controlled by the orbiting scroll side.

9 Claims, 9 Drawing Sheets

FIGURE 9 (A) PRIOR ART
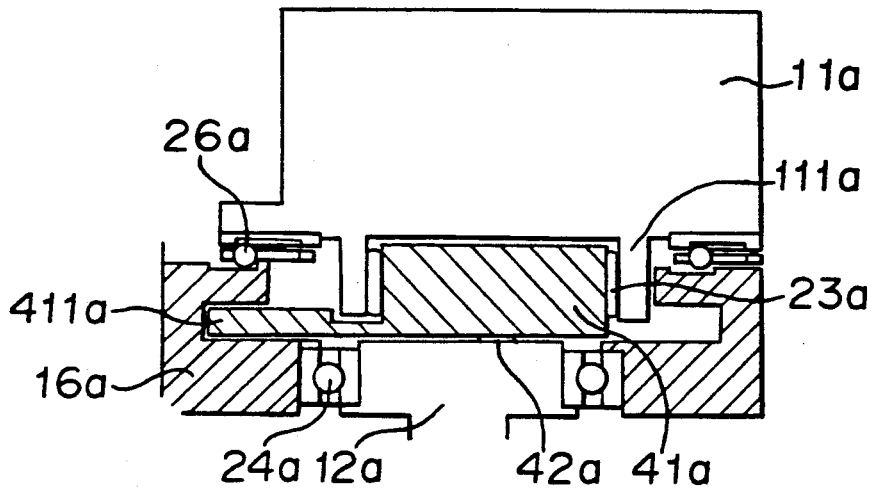
FIGURE 9 (B)
PRIOR ART
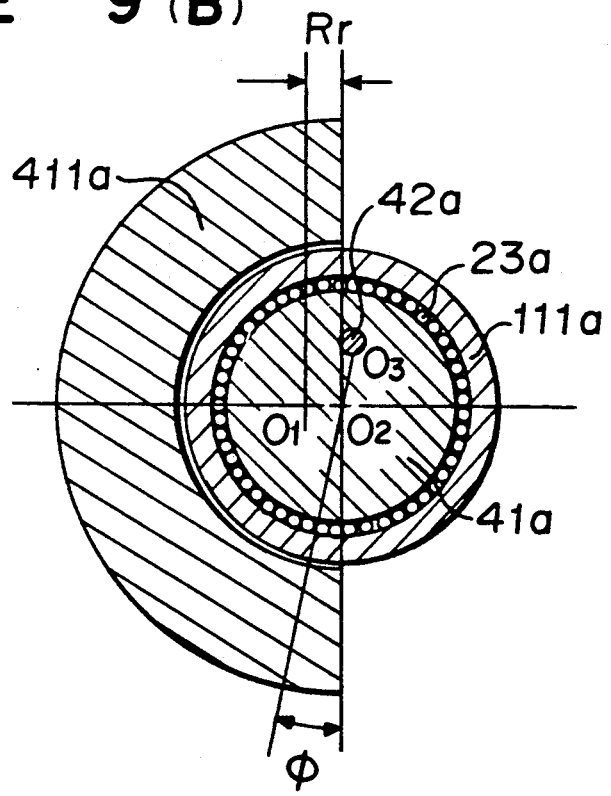

SCROLL-TYPE FLUID MACHINE WITH COUNTER-WEIGHT

BACKGROUND OF THE INVENTION

1. Field of the Invention

The present invention relates to a scroll-type fluid machine. More specifically, the present invention relates to a mechanism for canceling a centrifugal force applied to an orbiting scroll, and a seal mechanism and a relief mechanism at a gap between the spiral walls of orbiting and fixed scrolls in their radial direction.

2. Discussion of Background

Referring now to FIG. 6, there is shown the operating principal of a scroll-type fluid machine. Reference numeral 10 designates a fixed scroll. Reference numeral 11 designates an orbiting scroll. Reference character C designates a compression chamber which is defined between both scrolls 10 and 11. Reference numeral 101 designates a discharge port. The fixed scroll 10 and the orbiting scroll 11 have base plates, respectively, each of which has one side provided with a spiral wall having a similar shape. Each spiral wall has an involuted shape or a combination of circular arcs, which is well known. When the scroll-type fluid machine is used as a compressor, the fixed scroll 10 is fixed in terms of special relations, and the orbiting scroll 11 is combined with the fixed scroll 10 as shown in FIG. 6, and carries out such turning movement or orbital movement that the oribiting scroll 11 does not change its posture in terms of space. The orbital movement is made with a predetermined crank radius (orbiting radius) as shown in at 0°, 90°, 180° and 270° in FIG. 6. As the movement of the orbiting scroll 11 progresses, the area of the compression chamber C, which is defined between the fixed scroll 10 and the orbiting scroll 11, and which is in the form of crescent, is gradually decreased, so that a gas which entrapped in the compression chamber C is compressed, and is discharged from the discharge port 101. This is the operating principal of the scroll-type fluid machine.

Referring now to FIG. 7, there is shown an axial sectional view showing a compressor wherein a conventional scroll-type fluid machine is utilized. Reference numeral 10 designates a fixed scroll. Reference numeral 11 designates an orbiting scroll which has an orbiting shaft 112 on the back. Reference numeral 12 designates a driving shaft which has an orbiting bearing hole 121 eccentrically formed therein and is constructed with a counter-weight 122 into a single unit, the orbiting shaft 112 being fitted in the orbiting bearing hole 121 through an orbiting bearing 23. Reference numeral 13 designates an electric motor rotor which is constructed with the driving shaft 12 into a single unit. Reference numeral 14 designates an electric motor stator. Reference numerals 15 and 16 designates bearing supports. Reference numeral 17 designates a shell. Reference numeral 18 designates an intake tube which is attached to and through the shell 17. Reference numeral 19 designates a discharge tube which is attached to and through the shell 17 as well. Reference numeral 20 designates a discharge muffler which is arranged at the leading end of the discharge tube 19. Reference numeral 21 designates a check valve which is arranged at a discharge port 101. Reference numeral 22 designates an Oldham ring which is used to prevent the orbiting scroll 11 from rotating on its axis and to keep an angular position of the orbiting scroll 11 with respect to the fixed scroll 10. Reference numeral 24 designates a main bearing which is arranged to decrease the friction between the driving shaft 12 and the bearing support 16. Reference numeral 25 designates a subbearing which is used to support the driving shaft 12 at the side of the electric motor. Reference numeral 26 designates an annular thrust bearing to which the internal pressure in the compression chamber C and the tare of the orbiting scroll 11 are applied. Reference numeral 27 designates tipseals which are fitted in tipseal grooves in end surfaces of the spiral walls of the scrolls 10 and 11. Reference numeral 28 designates a foaming prevention plate. Reference numeral 29 designates a counter-weight which is mounted to the lower end of the rotor 13. Reference numeral 30 designates a lubricating oil pump which is attached to the lower end of the driving shaft 12.

Next, the operation of the scroll-type compressor shown in FIG. 7 will be explained. When the electric motor stator 14 is energized, the electric motor rotor 13 produces torque to rotate with the driving shaft 12. As a result, the torque is transmitted to the orbiting shaft 112 through the orbiting bearing 23 which is fitted in the orbiting bearing hole 121. The orbiting scroll 11 carries out orbiting movement without rotating on its own axis while being guided by the Oldham ring 22. In this way, the compression operation as shown in FIG. 6 is made. The tipseals 27 which are arranged at the leading edge of the spiral walls of both scrolls 10 and 11 seal gaps between the scrolls in their axial direction to prevent a gas from leaking in a radial direction from a higher pressure compression chamber C to a lower pressure compression chamber C. The gas which has flowed into the shell 17 through the intake tube 18 cools the electric motor rotor 13 and the electric motor stator 14 and the like. After that, the gas entrapped in the compression chamber C is compressed there, and is discharged from the discharge tube 19 through the discharge port 101.

In the conventional scroll-type compressor described above, the orbiting scroll 11 is eccentrically arranged with respect to the driving shaft 12. Rotary machines having such arrangement require that the counter-weight 122 be provided to cancel a centrifugal force which is applied to the eccentric portion. It is conventional that the counter-weight 122 is attached to the driving shaft 12 or the electric motor rotor 13 because the counter-weight 122 must rotate in phase with the eccentric portion and about the rotational center of the shaft in terms of its function.

Referring now to FIG. 8, there is shown an enlarged view of the essential parts of the compressor shown in FIG. 7. A centrifugal force which is generated at the orbiting scroll 11 is transmitted to the driving shaft 12 through the orbiting bearing 23, and is canceled by the counter-weight 122 which is constructed with the driving shaft 12 in a single unit. It means that the orbiting bearing 23 works while being subjected to a centrifugal load from the orbiting scroll 11, and that the centrifugal load is relevant to bearing loss of the orbiting bearing 23. When the centrifugal force is increased due to a high speed operation, the center of the orbiting shaft 112 has greater deviation in the orbiting bearing 23 in a direction where the orbiting radius increases. As a result, the side surfaces of the spiral wall of both scrolls 10 and 11 start to touch with each other to a large extent. Once the side surfaces of the spiral walls have started to touch to such a large extent, the centrifugal force acts against the side surface of the spiral walls to produce sliding loss on the side surfaces of the spiral wall. Because the coefficient of friction of the side surfaces is greater than that of the orbiting bearing 23, the sliding loss on the side surfaces is great. In addition, if an abnormal high pressure is generated in the compression chamber due to liquid compression or the like, a load due to such high pressure can be applied to the bearing to damage it since it is impossible to form a gap through which the high pressure is relieved.

As explained above, the conventional technique wherein the fixed crank having an invariable orbiting radius is used to mount the counter-weight 122 to the driving shaft 12 involves three problems;

(1) a centrifugal load increases bearing loss at the orbiting bearing 23 under normal operations.

(2) sliding loss becomes great at the side surfaces of the spiral walls of both scrolls 10 and 11 when the side surfaces of the spiral walls touch each other under high speed operations.

(3) there is no relief function against abnormal internal pressures.

In order to obviate the problem (2), a so-called swing link system has been proposed wherein a mechanical link unit having flexibility in a radial direction is arranged between a driving shaft and an orbiting scroll, and wherein a counter-weight is mounted to the link unit. Referring now to FIGS. 9(A) and 9(B), there is shown an example of the swing link system disclosed in e.g. Japanese Examined Patent Publication No. 19875/1983. FIG. 9 (A) is a vertical sectional view showing the essential parts of the system. FIG. 9 (B) is a partial horizontal sectional view of the essential parts. As shown in these Figures, a driving shaft 12*a* is rotatably supported by a bearing support 16*a* through a ball bearing 24*a*. A driving pin 42*a* is uprighted at an eccentric position on top of the driving shaft 12*a*. About the center $O_3$ of the driving pin 42*a* is rotatably arranged a bushing 41*a* which in turn has its periphery provided with a boss 111*a* through a needle bearing 23*a*, the boss 111*a* projecting from the lower end of an orbiting scroll 11*a*. In addition, between the bearing support 16*a* and the orbiting scroll 11*a* is provided a rotation preventing mechanism 26*a*. A counter-weight 411*a* is formed with the bushing 41*a* in one unit. In this system, the rotation of the driving shaft 12*a* is transmitted to the orbiting scroll 11*a* through the driving pin 42*a*, and the bushing 41*a* and the needle bearing 23*a*. The orbiting scroll 11*a* carries out orbiting movement while it is prevented from rotating by the rotation preventing mechanism 26*a*. In this case, the crank radius (orbiting radius) is the distance Rr from the center $O_1$ of the driving shaft 12*a* to the center of the orbiting scroll 11*a* or the center $O_2$ of the busing 41*a*. A centrifugal force Fc which is caused at the orbiting scroll 11*a* is canceled by the counter-weight 411*a* which is formed with the bushing 41*a* in one unit. As a result, where a circumferential component of a gas force acting on the orbiting scroll 11*a* at angle $\theta$ is defined as $F_g\theta$, and a radial component of the gas force is defined as $F_{gr}$, the force which is defined by the equation, $F_s = F_g\theta \cdot \tan\phi - F_{gr}$, draws the link mechanism between the centers $O_2$ and $O_3$ in a direction wherein the crank radius $R_r$ increases. The force is a pressing force which acts between the side surfaces of the spiral walls of a fixed scroll and the orbiting scroll 11*a* because the force $F_s$ is supported at the contacting points of both spiral walls.

Although the swing link system causes the spiral walls of both scrolls to be in touch with each other at all times, the force which is supported by the side surfaces of both spiral walls is not dependent on the revolution because the force is not related to centrifugal force. As a result, the sliding loss at the side surfaces of both spiral walls will not increase even when a high speed operation is made. However, the centrifugal force which is caused at the orbiting scroll 11*a* is balanced by the counter-weight 411*a* which is formed with the bushing 41*a* in one unit, and the problem of item (1) is not overcome because such swing link system is not different from the device of FIGS. 7 and 8 in that a centrifugal load is applied to the needle bearing 23*a* which acts as an orbiting bearing between the two parts 41*a* and 11*a*. In addition, when an abnormal high pressure occurs, the gap between both scrolls in their radial direction is sealed to prevent the pressure from escaping through the gap for relief because the pressing force against the side surfaces of both scrolls derives from the pressure of the gas. It means that the problem pointed out in the above mentioned item (3) is not overcome.

As discussed above, although the conventional scroll-type fluid machines can prevent sliding loss between the side surfaces of the spiral walls of a fixed scroll and an orbiting scroll at a high speed operation from increasing, the bearing loss which is caused by the centrifugal load acting on a sliding bearing portion can not be restrained from increasing, and pressure relief can not be made when an abnormal high pressure is caused.

SUMMARY OF THE INVENTION

It is an object of the present invention to solve the problems of the conventional devices and to provide a new and improved scroll-type fluid machine capable of preventing a centrifugal force from acting against both the side surfaces of the spiral walls of a fixed scroll and an orbiting scroll, and a sliding bearing portion of the orbiting scroll, and including a radial seal relief mechanism which allows the gap between the spiral walls in their radial direction to open, thereby to relieve an internal pressure when an abnormal high pressure occurs.

The foregoing and other objects of the present invention have been attained by providing a scroll-type fluid machine comprising a fixed scroll having a spiral wall; an orbiting scroll having a base plate which on one side provided with a spiral wall, the orbiting scroll having the spiral wall combined with the spiral wall of the fixed scroll; a rotation preventing mechanism for preventing the orbiting scroll from rotating about its own axis; a driving shaft which is driven by a driving source, which has an eccentric portion, the eccentric portion causing the orbiting scroll side to carry out orbiting movement through an orbiting bearing; and a counter-weight which is coupled to the driving shaft at an eccentric position whose eccentricity is opposite the eccentric portion of the driving shaft and it has a play with respect to the driving shaft in a radial direction. The counter-weight bears radially on a part moving with the orbital scroll as as to balance at least part of a centrifugal force caused at the orbiting scroll.

Preferably, the scroll-type fluid machine according to the present invention includes an orbiting bushing which is arranged to be movable in a radial direction with respect to the driving shaft, and which is interposed between the driving shaft and the orbiting scroll; and pushing means for urging the orbiting bushing in a radially outward direction with respect to the driving shaft.

In accordance with the scroll-type fluid machine of the present invention, the counter-weight is revolved in such manner that it constantly takes a symmetrical position with respect to the orbiting scroll, thereby balancing the entire or at least part of a centrifugal force which is caused at the orbiting scroll. The radial position of the counter-weight is controlled by the orbiting scroll or parts which carries out orbiting movement with the orbiting scroll in one unit. The centrifugal force and a force canceling it act on each other through the contacting points where the counter-weight touches with the part for controlling the radial movement of the counter-weight.

In addition, in the preferable manner of the present invention, the orbiting radius of the orbiting scroll is determined by the distance from the center of the orbiting bushing and the center of the driving shaft, and the pushing means urges the orbiting bushing in a radially outward direction. As a result, the gap in a radial direction between the spiral walls in rotation is made zero.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 9(A) is an axial sectional view showing the essential parts of another conventional scroll-type compressor; and FIG. 9(B) is a radial sectional view of the essential parts of the scroll-type compressor of FIG. 9(A).

DETAILED DESCRIPTION OF THE PREFERRED EMBODIMENTS

Figure 1:
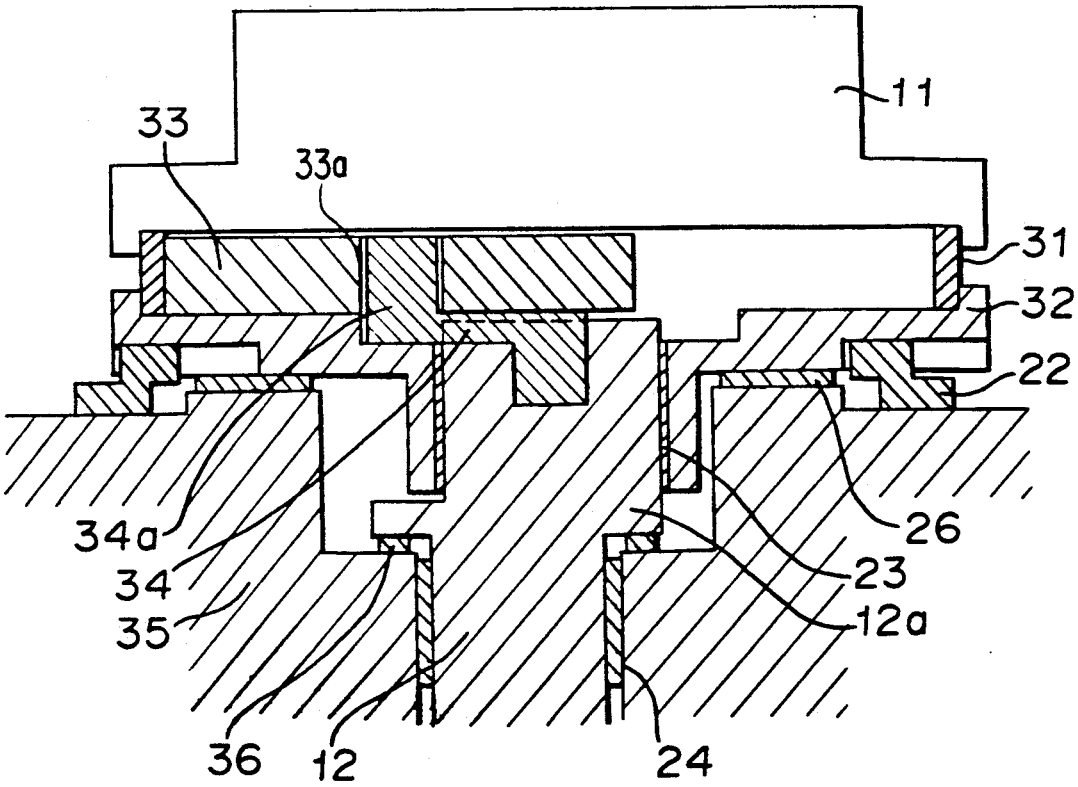
FIG. 1 is an axial sectional view showing the essential parts of a first embodiment of the scroll-type fluid machine according to the present invention.

Referring now to the drawings, wherein like reference numerals designate identical or corresponding parts throughout the several views, and more particularly to FIG. 1 thereof, there is shown an axial sectional view showing the essential parts of a first embodiment of the scroll-type compressor wherein the scroll-type fluid machine according to the present invention is applied. In FIG. 1, reference numeral 11 designates an orbiting scroll. Reference numeral 31 designates a counter-weight guide which has a ring shape and which carries out orbiting movement together with the orbiting scroll 11 as one unit. Reference numeral 32 designates a base plate which has an orbiting bearing 23 at a central portion. A driving shaft 12 has an eccentric portion 12*a* on top, which is fitted into the orbiting bearing 23. Reference numeral 35 designates a bearing support. Reference numeral 22 designates an Oldham ring which prevents the orbiting scroll 11 from rotating about its own axis and controls the posture of the orbiting scroll 11 through the base plate 32 and the counter-weight guide 31. Reference numeral 24 designates a main bearing which is arranged between the bearing support 35 and the driving shaft 12. Reference numeral 26 designates a thrust bearing which is used to bear a force in an axial direction or the like, which is caused by the gas pressure in a compression chamber defined by both scrolls 10 and 11. Reference numeral 36 designates a thrust bearing which is arranged between the bearing support 35 and the driving shaft 12. Reference numeral 34 designates a crank pin which forms a crank by coupling the driving shaft 12 and a counter-weight 33 positioned within the ring-shaped counter-weight guide 31 in such manner that the center of the counter-weight and the center of the driving shaft eccentric portion 12*a* are connected with each other. The counter-weight 33 is eccentrically positioned to the side opposite the eccentric portion 12*a*, and is coupled to the crank pin 34 with play in a radial direction therebetween. The counter-weight 33 is revolved by the driving shaft 12 through the crank pin 34 while the counter-weight 33 has its radial position controlled by the counter-weight guide 31. A centrifugal force which acts on the orbiting scroll 31 is balanced in that way.

Figure 2:
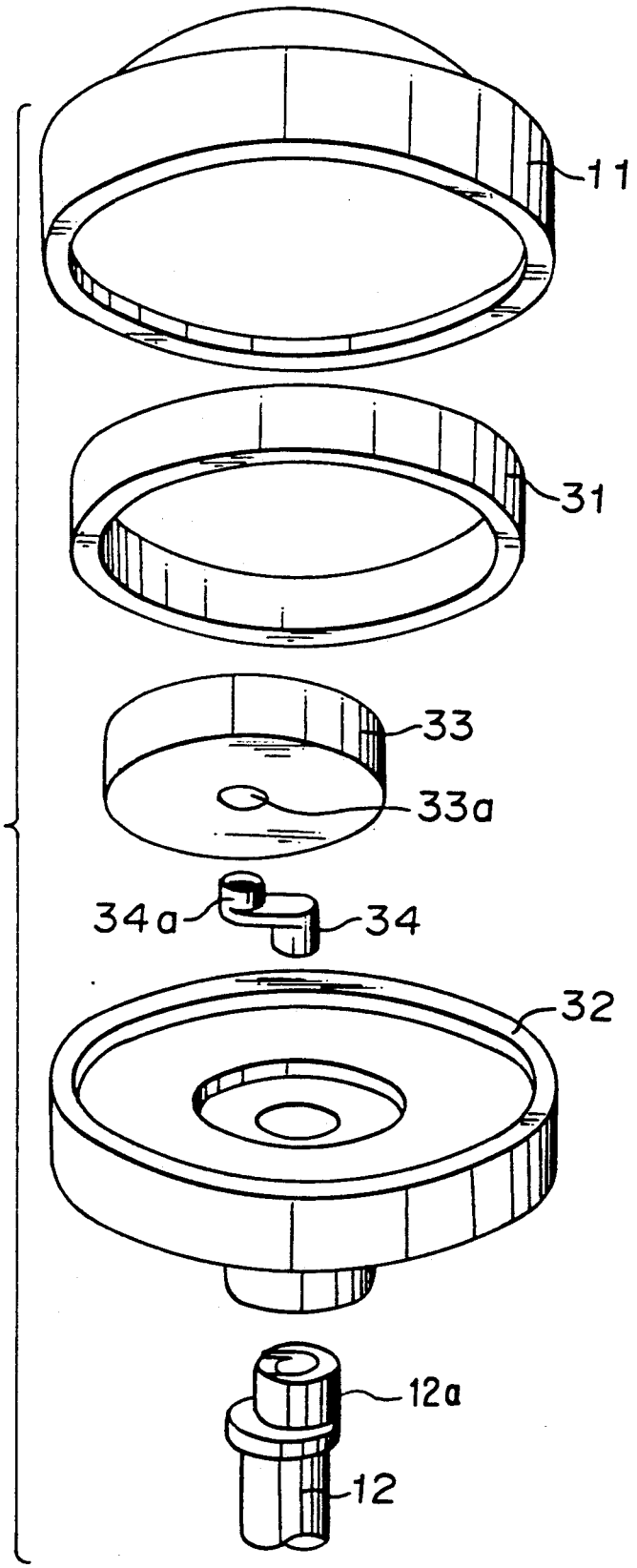
FIG. 2 is a perspective exploded view showing the essential parts of the first embodiment.

FIG. 2 is a perspective exploded view showing the parts 11, 12, 31, 32, 33 and 34. The counter-weight 33 is in the form a flat column, and the counter-weight has a central opening 33*a*. The crank pin 34 has a connecting portion 34*a* inserted into the central opening 33*a*, the connecting portion 34*a* being slightly smaller than the central opening 33*a* in diameter. The counter-weight 33 is driven by the crank pin 34 to revolve about the eccentric portion 12*a* of the driving shaft 12 while the counter-weight 33 takes a position symmetrical with the eccentric direction of the orbiting scroll 11. At this time, the revolution radius of the counter-weight 33 is controlled by the outer counter-weight guide 31, not the crank pin 34. On the other hand, the orbiting scroll 11 is assembled with the counter-weight guide 31 and the base plate 32 in one unit. The rotation of the driving shaft 12 causes the eccentric portion 12*a* to revolve about the center of the driving shaft 12, resulting in orbiting movement of the orbiting scroll 11.

Figure 3:
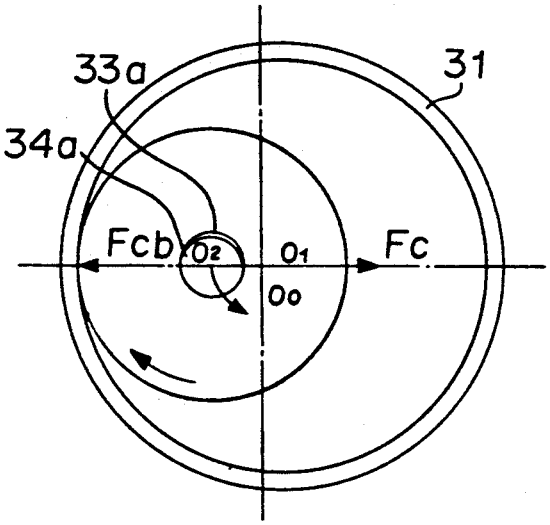
FIGS. 3(*a*) through 3(*d*) are sectional views to help explain the operation of a counter-weight in accordance with the present invention.
Figure 3:
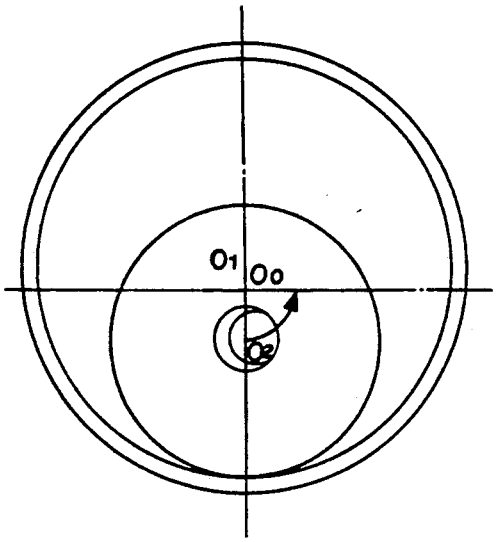
Figure 3:
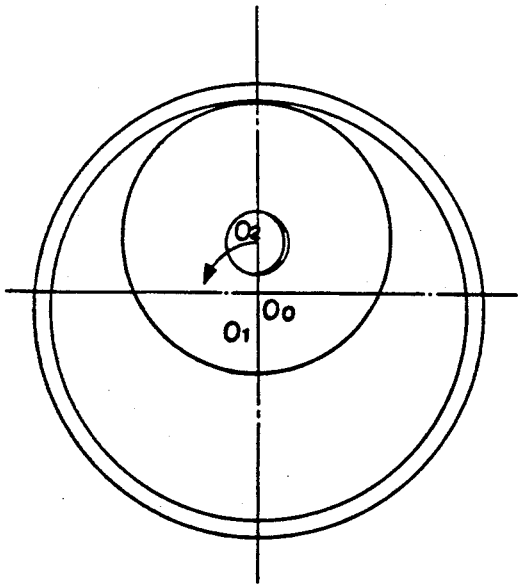
Figure 3:
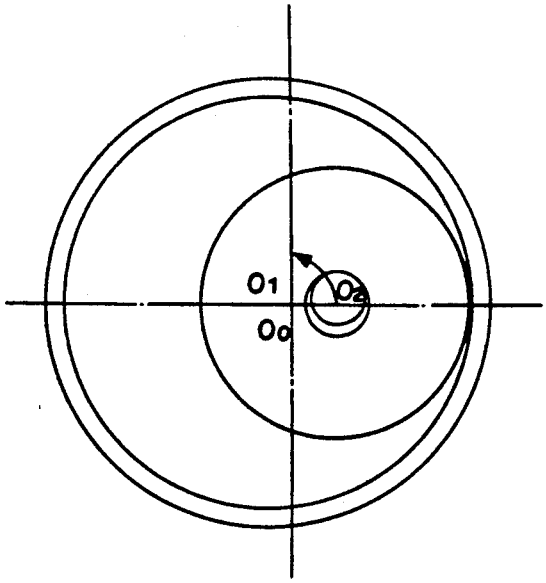

Referring now to FIGS. 3(*a*) through 3(*d*), there are shown schematic views showing the operation of the counter-weight 33. A centrifugal force Fcb which is caused at the counter-weight 33 acts on the contacting point with the counter-weight guide 31 to balance with a centrifugal force Fc which is caused at the orbiting scroll 11. The difference between a friction force caused between the outer circumferential surface of the counter-weight 33 and the inner circumferential surface of the counter-weight guide 31, and a friction force caused between the central opening 33*a* of the counter-weight 33 and the connecting portion 34*a* of the crank pin 34 causes the counter-weight 33 to rotate. The movement of the counter-weight 33 is rolling with a slight slip on the inner circumferential surface of the counter-weight guide 31. The conventional devices wherein centrifugal forces act on orbiting bearings involve a slip for each turn of the shaft, whereas the embodiment can obtain almost rolling movement. By the way, reference character $O_0$ designates the center of the driving shaft 12. Reference character $O_1$ designates the center of the guide 31 and $O_2$ designates the center of the counter-weight 33. The structure and the operation of other parts of the compressor wherein the embodiment is applied is similar to the conventional devices.

In the first embodiment, the counter-weight 33, and the counter-weight guide 31 which is assembled with the orbiting scroll 11 in one unit are in direct contact with each other to cancel the centrifugal forces, allowing bearing loss to be minimized without applying any centrifugal load to the orbiting bearing 23. Even when the side surfaces of the spiral walls of both scrolls 10 and 11 touch each other, a centrifugal load is not applied to the contacting points, which can minimize sliding loss on the wall surfaces under high speed operations.

Figure 4:
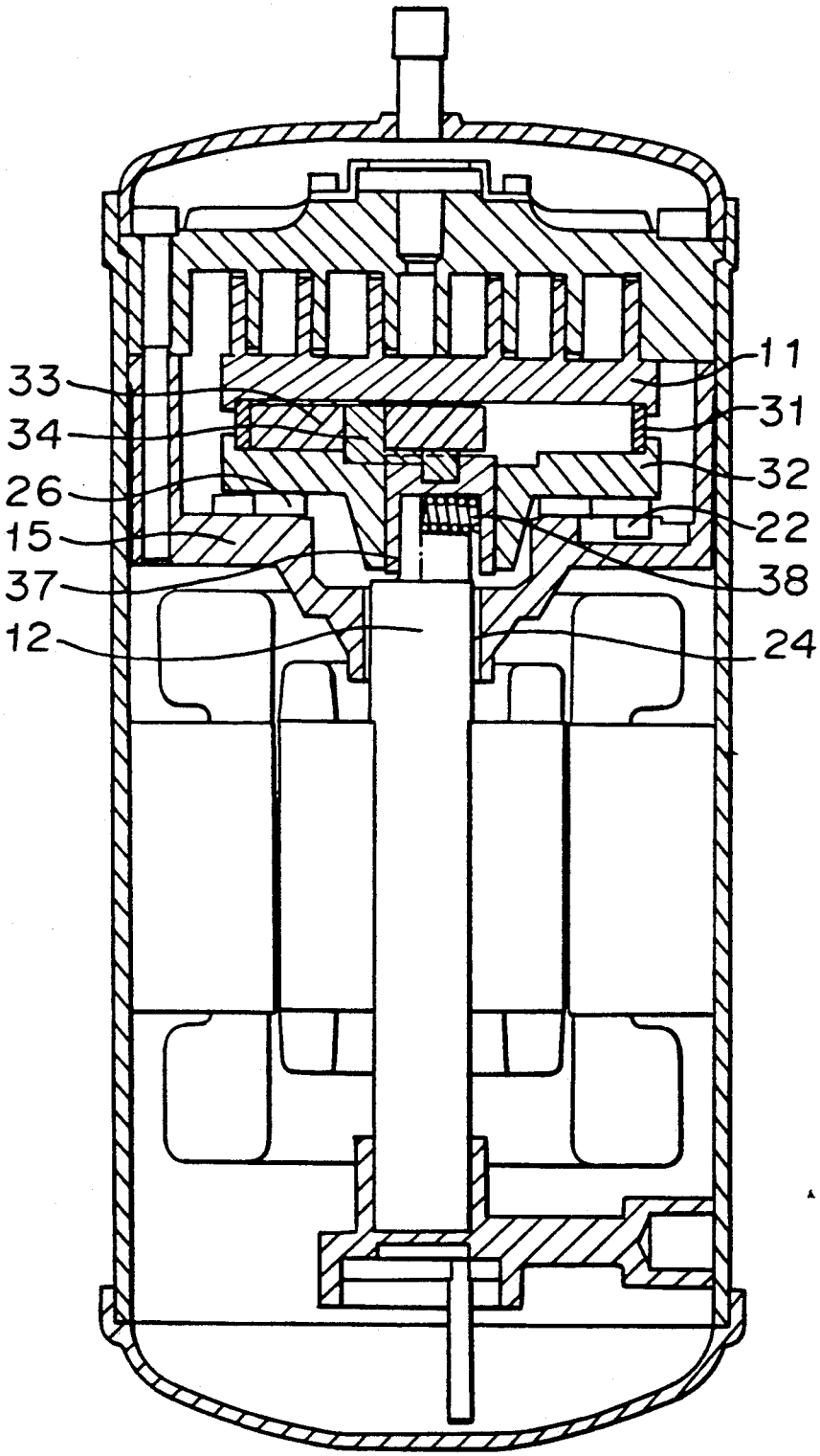
FIG. 4 is an axial sectional view showing the scroll compressor of a second embodiment wherein the scroll fluid machine according to the present invention is applied.
Figure 5:
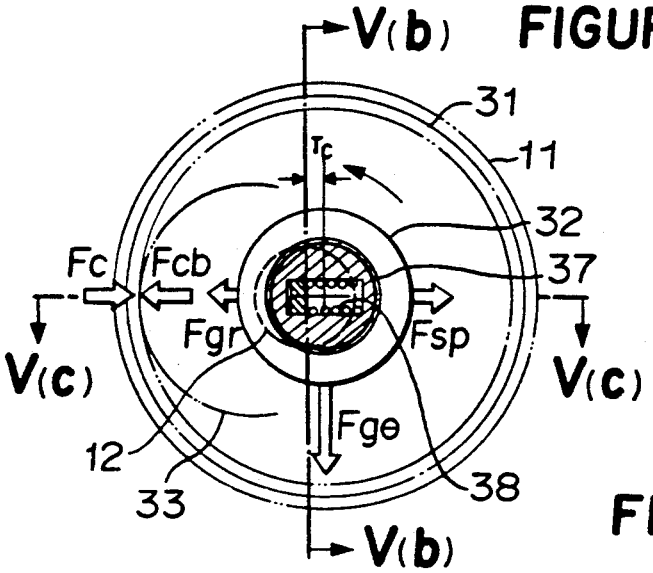
FIGS. 5(*a*), 5(*b*) and 5(*c*) are showing the essential parts of the scroll-type compressor of FIG. 4, FIGS. 5(*b*) and 5(*c*) being sectional views taken along the line V(*b*)—V(*b*) and the line V(*c*)—V(*c*), respectively.
Figure 5:
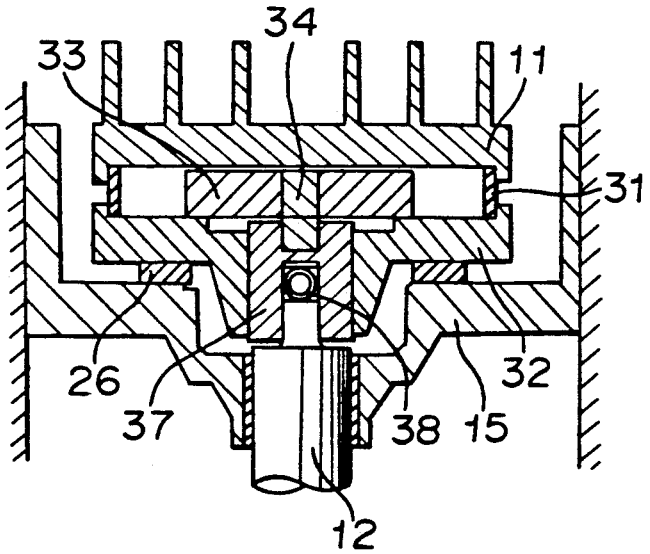
Figure 5:
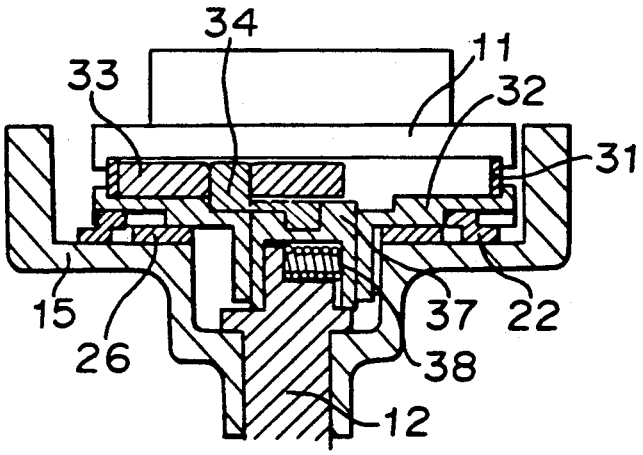
Figure 6:
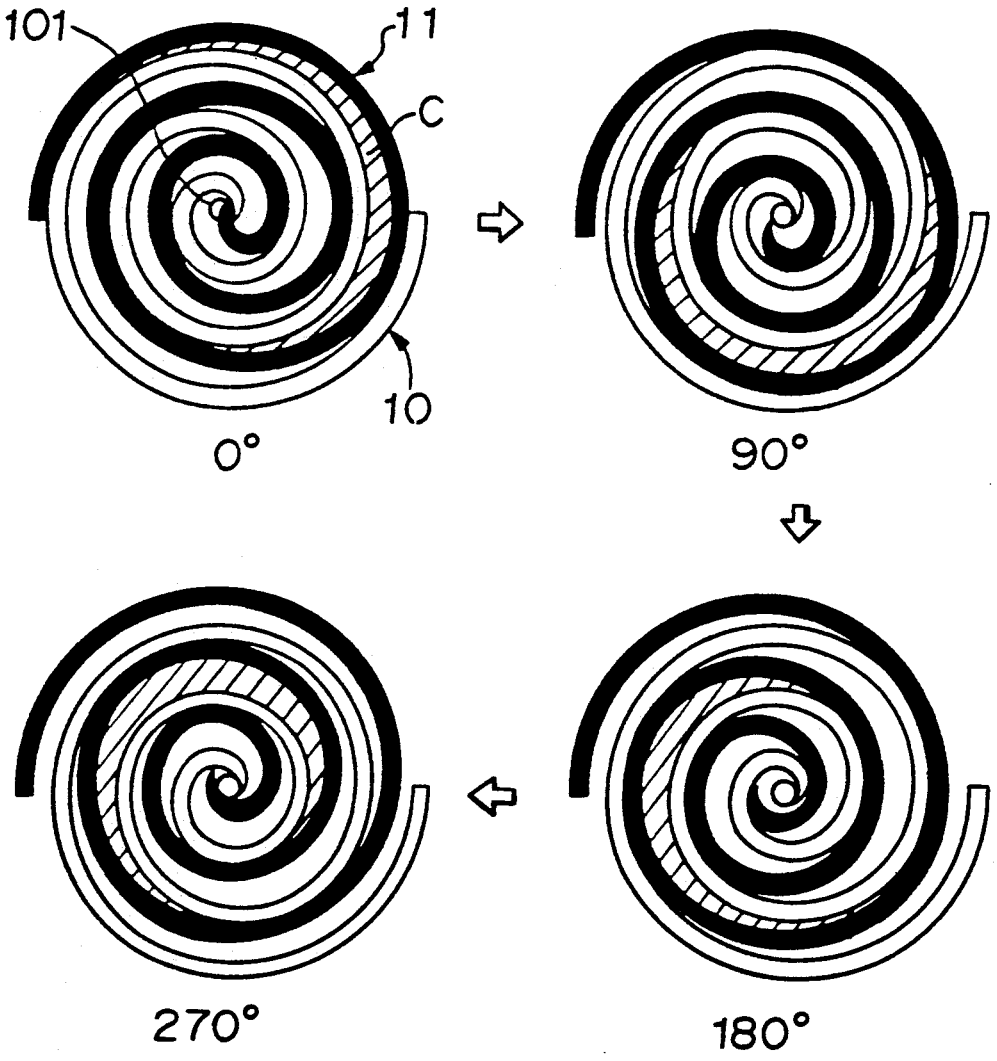
FIG. 6 is a schematic view showing the operating principal of the scroll-type fluid machine.
Figure 7:
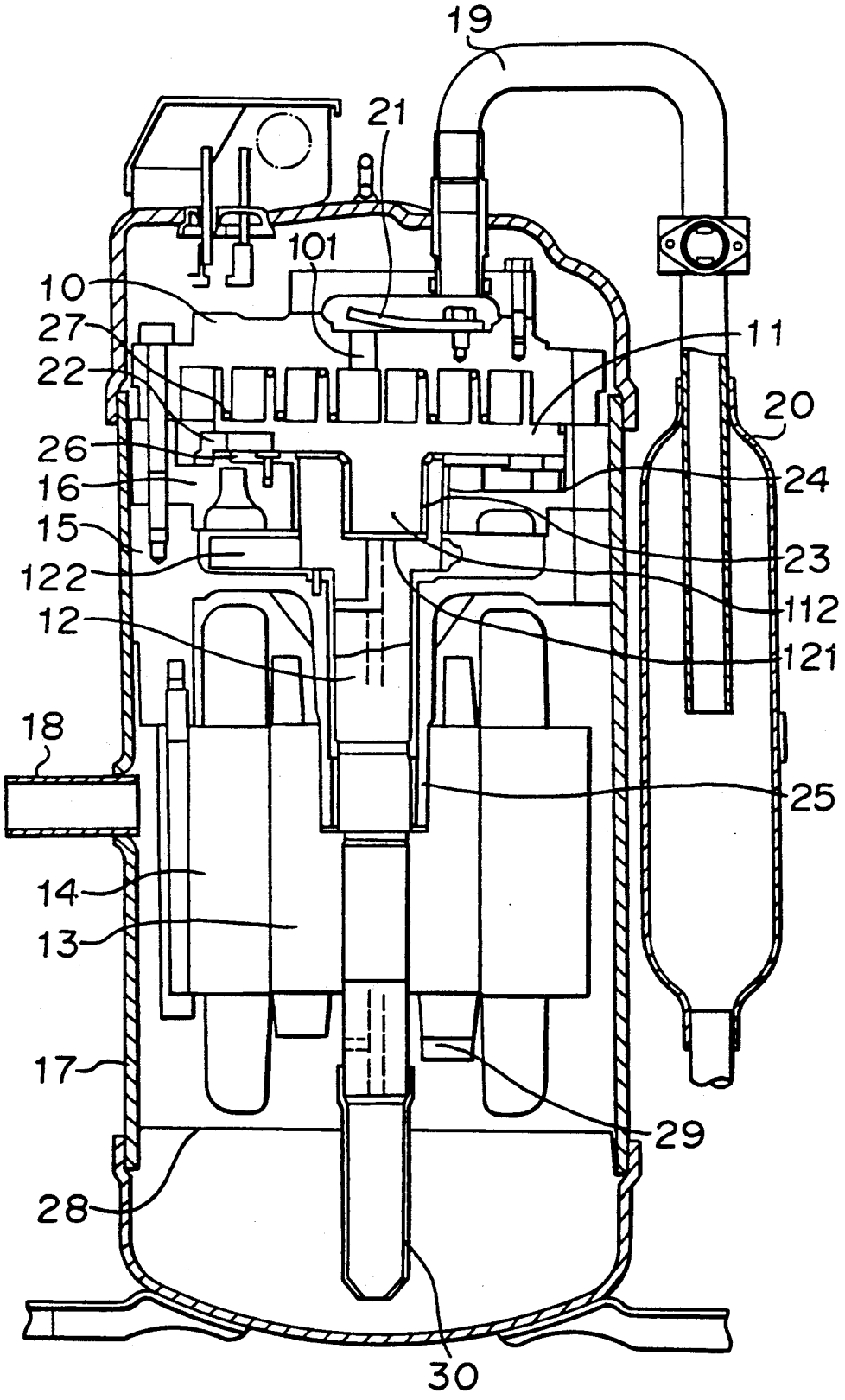
FIG. 7 is an axial sectional view of a conventional scroll-type compressor.
Figure 8:
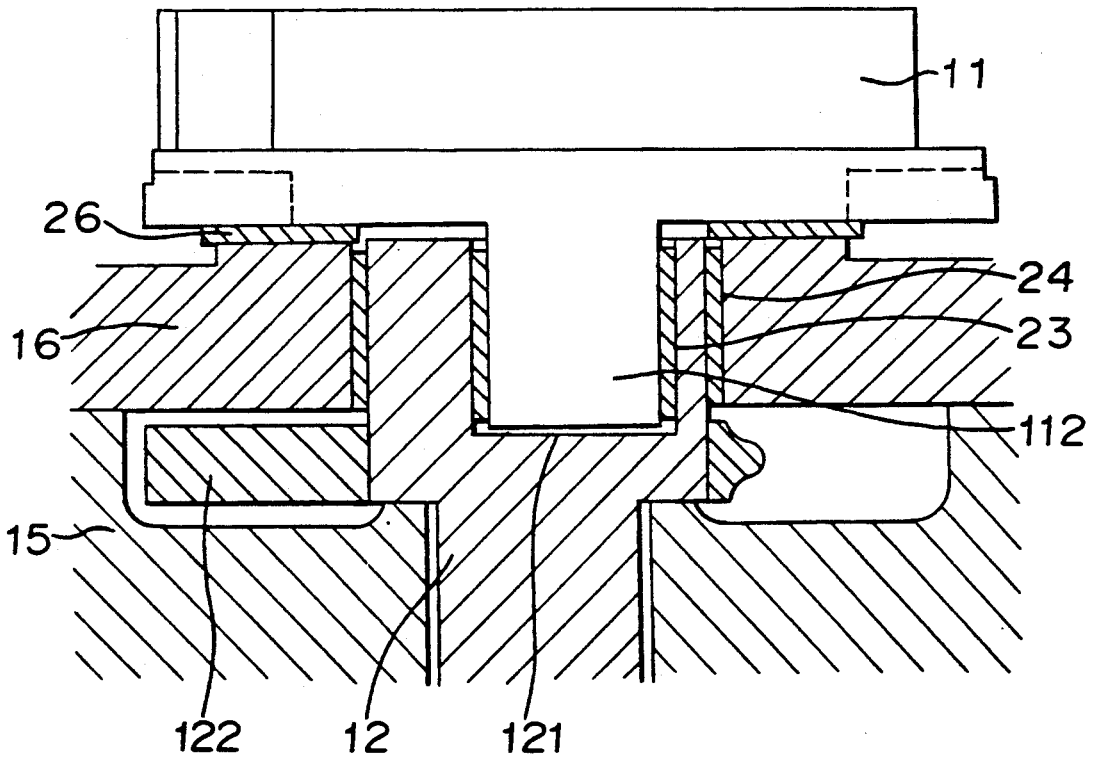
FIGURE 8 PRIOR ART
FIG. 8 is an enlarged view showing the essential parts of the conventional scroll-type compressor.

Referring now to FIGS. 4, and 5(*a*) through 5(*c*), there is shown a second embodiment of the scroll-type compressor wherein the scroll-type fluid machine according to the present invention is applied. In FIGS. 4, and 5(*a*) through 5(*c*), reference numeral 37 designates an orbiting bushing which is interposed between the driving shaft 12 and the orbiting scroll 11 to increase and decrease the orbiting radius of the orbiting scroll 11. Reference numeral 38 designates a spring which is used to push the orbiting bushing 37 in a radially outward direction with respect to the driving shaft 12. Because the structure of the other parts is like the first embodiment of FIG. 1 and the conventional scroll-type compressor of FIG. 7, these parts are indicated the same reference numerals, and explanation of the parts will be omitted. In the second embodiment, the crank pin 34 has one end fitted into the orbiting bushing 37 and the other end put into the central opening of the counter-weight 33 to form a crank in such manner that the center of the counter-weight 33 and the center of the driving shaft eccentric portion 12*a* are connected together to couple the counter-weight 33 to the driving shaft 12.

In accordance with the second embodiment of the scroll-type compressor, as clearly shown in FIGS. 5(*a*) through 5(*c*), the orbiting bushing 37 is arranged to be capable of moving in a radial direction with respect to the driving shaft 12, and the orbiting bushing 37 is urged by the spring 38 in a radially outward direction. As a result, the side surface of the spiral wall of the orbiting scroll 11 touches that of the fixed scroll to carry out orbiting movement at such an orbiting radius that the gap between the spiral walls in a radial direction is zero. A centrifugal force Fc which acts on the orbiting scroll and assembled parts which carry out orbiting movement together with the orbiting scroll is canceled by a centrifugal force Fcb in the orbiting assembled parts to have no influence on the side surfaces of the spiral walls of both scrolls. Because a pressing force Fs to the side surfaces of the spiral wall is the difference between a force Fsp given by the spring and a radial component Fgr of a force given by a gas pressure, the pressing force Fs is expressed as follows:

$$F = Fsp - Fgr$$

In FIG. 5(*a*), reference numeral $r_c$ designates the crank radius which is the distance between the center of the driving shaft 12 (the center of the fixed scroll 10) and the center of the orbiting bearing 23 (the center of the orbiting scroll 11). Reference numeral $Fg\theta$ designates a circumferential component of the force which is applied to the orbiting scroll by the gas pressure produced in the compression chamber. The gas pressure can be divided into the circumferential component and a crank-radial component, the circumferential component being perpendicular to the crank-radial component.

In accordance with the scroll-type fluid machine of the second embodiment of the present invention, the orbiting scroll is driven through the orbiting bushing which is movable in a radial direction with respect to the driving shaft and is urged in an outward direction. This arrangement can provide a seal relief mechanism wherein the pushing force which act at the gap between the side surfaces of the spiral walls in a radial direction is independent of revolution. It is possible to obtain a scroll-type fluid machine which can minimize sliding loss and leakage loss, and is efficient and reliable.

Obviously, numerous modifications and variations of the present invention are possible in light of the above teachings. It is therefore to be understood that within the scope of the appended claims, the invention may be practiced otherwise than as specifically described herein.

What is claimed is:

1. A scroll-type fluid machine comprising:

a fixed scroll having a spiral wall;

an orbiting scroll having a base plate including one side provided with a spiral wall, the orbiting scroll having the spiral wall combined with the spiral wall of the fixed scroll to define at least one compression chamber;

a rotation preventing mechanism for preventing the orbiting scroll from rotating about its own axis;

a driving shaft which is driven by a driving source, which has an eccentric portion, the eccentric portion causing the orbiting scroll to carry out orbiting movement via an orbiting bearing;

a counter-weight coupled to the driving shaft at an eccentric position whose eccentricity is opposite the eccentric portion of the driving shaft, said counter-weight having a play with respect to the driving shaft in a radial direction, and bearing radially on a part moving with said orbiting scroll so as to balance at least part of a centrifugal force caused at the orbiting scroll;

an orbiting bushing mounted on said driving shaft and arranged to be movable in a radial direction with respect to the driving shaft, said bushing being interposed between the driving shaft and the orbiting scroll; and pushing means in said bushing for urging the orbiting bushing in a radially outward direction with respect to the driving shaft, said counter-weight being operatively connected to said bushing, wherein said counter-weight is mounted to said driving shaft via said bushing.

2. A scroll-type fluid machine according to claim 1, wherein the orbiting scroll has a counter-weight guide assembled unitarily therewith, as said part moving with said orbiting scroll.

3. A scroll-type fluid machine according to claim 2, wherein the counter-weight is arranged within the counter-weight guide and has radial movement controlled by the counter-weight guide.

4. A scroll-type fluid machine according to claim 1, wherein the counter-weight is coupled to the bushing through a crankpin.

5. A scroll-type fluid machine according to claim 4, wherein the crankpin has one end provided with a connecting portion which is coupled with the bushing.

6. A scroll-type fluid machine according to claim 5, wherein the crankpin has the other end coupled to the counter-weight.

7. A scroll-type fluid machine according to claim 6, wherein the counter-weight has a central opening.

8. A scroll-type fluid machine according to claim 7, wherein the other end of the crankpin is slightly smaller than the central opening of the counter-weight in diameter, thereby establishing the play with respect to the driving shaft.

9. A scroll-type fluid machine according to claim 1, wherein the pushing means is composed of a spring which is arranged in the orbiting bushing.

* * * * *